US007137844B2

(12) United States Patent
Flowers et al.

(10) Patent No.: US 7,137,844 B2
(45) Date of Patent: Nov. 21, 2006

(54) LEVER TYPE ELECTRICAL CONNECTOR WITH CPA MEMBER

(75) Inventors: Robert J. Flowers, Ortonville, MI (US); Keith G. Koehler, Farmington Hills, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/299,922

(22) Filed: Dec. 12, 2005

(65) Prior Publication Data

US 2006/0089031 A1 Apr. 27, 2006

Related U.S. Application Data

(63) Continuation of application No. 10/402,655, filed on Mar. 28, 2003, now abandoned.

(51) Int. Cl.
*H01R 13/62* (2006.01)

(52) U.S. Cl. ..... 439/372

(58) Field of Classification Search ..... 439/157, 439/372, 489
See application file for complete search history.

(56) References Cited

U.S. PATENT DOCUMENTS 6,241,540 B1 * 6/2001 Tokuwa ..... 439/157
6,319,050 B1 * 11/2001 Miyazaki et al. ..... 439/489

* cited by examiner

*Primary Examiner*—Ross Gushi
(74) *Attorney, Agent, or Firm*—Romi N. Bose

(57) ABSTRACT

An electrical connector includes a connector body and a wire shroud secured to the connector body. A mating assist lever is pivotally mounted on the body to be pivotable between an inoperative position and a latched position. A connector position assurance (CPA) member is slidably mounted on the mating assist lever to be slidable between an inoperative position and a locked position. Complementary interengaging locks are provided between the CPA member and the wire shroud to lock the mating assist lever in its latched position when the CPA member is moved to its locked position.

6 Claims, 6 Drawing Sheets

FIG.7
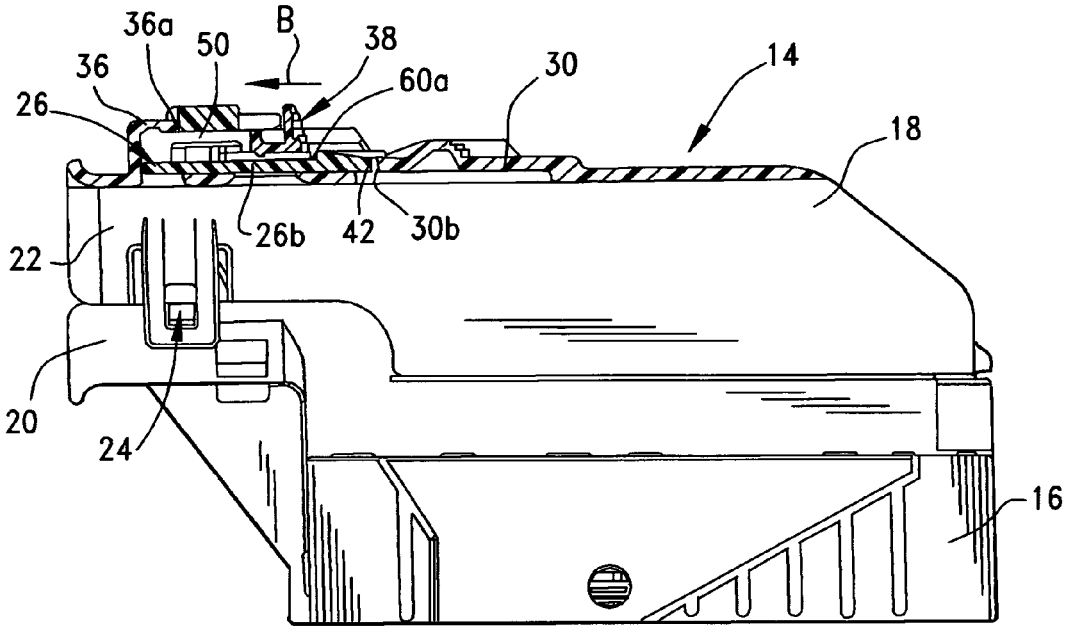
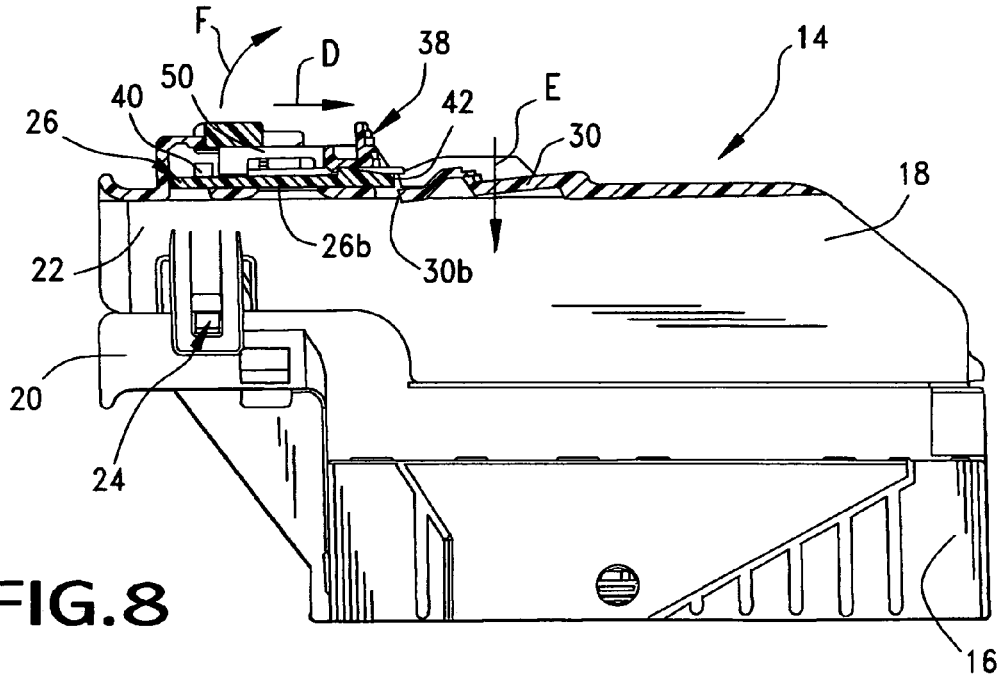
FIG.8

LEVER TYPE ELECTRICAL CONNECTOR WITH CPA MEMBER

This application is a continuation of Ser. No. 10/402,655 filed on Mar. 28, 2003 now abandoned.

FIELD OF THE INVENTION

This invention generally relates to the art of electrical connectors and, particularly, to a lever-type electrical connector having a connector position assurance (CPA) member slidably mounted directly on the lever of the connector.

BACKGROUND OF THE INVENTION

With some electrical connectors, large forces are required to mate and unmate a connector with an associated connector because the connectors have a large number of terminals. Consequently, low-insertion-force connectors have been developed which enable mating and unmating with small forces by means of an operating lever. A typical lever-type electrical connector includes a first connector which has an actuating lever rotatably or pivotally mounted thereon for connecting and disconnecting the connector with a complementary mating second connector. The actuating lever and the second connector typically operate through some form of cam groove/cam follower arrangement for drawing the second connector into mating condition with the first connector in response to rotation of the lever. One type of structure for a lever-type electrical connector is to provide a generally U-shaped lever structure which has a pair of lever arms that are disposed on opposite sides of the first ("actuator") connector.

In the above-mentioned lever-type connector, it often is difficult if at all possible to confirm whether or not the connector is fully mated with the second or complementary mating connector. Even if initially connected, in some applications such as vehicular or automotive applications, the connectors may become detached from each other by severe vibrations or the like. The present invention is directed to solving these problems in a lever-type electrical connector by employing a connector position assurance (CPA) member slidably mounted directly on the lever structure, the CPA member not only detecting a fully mated condition of the connector, but the CPA member also locks the lever structure in its mated position.

SUMMARY OF THE INVENTION

An object, therefore, of the invention is to provide a new and improved lever-type electrical connector with a connector position assurance (CPA) system.

In the exemplary embodiment of the invention, the connector includes a connector body and a wire shroud secured to the body. A mating assist lever is pivotally mounted on the connector body so as to be pivotable between an inoperative position and a latched position. A connector position assurance (CPA) member is slidably mounted on the mating assist lever so as to be slidable between an inoperative position and a locked position. Complementary interengaging lock means are provided between the CPA member and the wire shroud to lock the mating assist lever in its latched position when the CPA member is moved to its locked position.

As disclosed herein, the mating assist lever is generally U-shaped and has a pair of lever arms joined by a cross portion. The lever arms are pivotally mounted to the connector body. The CPA member is slidably mounted on the cross portion. The connector also includes complementary interengaging latch means between the cross portion of the mating assist lever and the wire shroud to hold the mating assist lever in its latched position.

According to one aspect of the invention, complementary interengaging retaining means are provided between the CPA member and the mating assist lever to prevent the CPA member from slidably moving from its inoperative position until the lever is in its latched position. Generally, release means are provided on the wire shroud for releasing the retaining means when the mating assist lever is in its latched position and, thereby, allow the CPA member to move from its inoperative position to its locked position. In the exemplary embodiment of the invention, the retaining means include at least one flexible retaining arm on the CPA member engageable with a locking shoulder on the mating assist lever. The wire shroud includes a release member engageable with the flexible retaining arm when the mating assist lever is in its latched position to move the arm out of engagement with the locking shoulder so that the CPA member can move from its inoperative position to its locked position.

According to another aspect of the invention, the complementary interengaging lock means between the CPA member and the wire shroud include a ledge on the wire shroud beneath which a portion of the CPA member moves to its locked position when the mating assist lever is in its latched position. In the exemplary embodiment, the at least one flexible retaining arm is the portion of the CPA member which moves beneath the ledge on the wire shroud.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 7 is a view similar to that of FIG. 6, with the CPA member moved from its inoperative position of FIG. 6 to its locked position;

FIG. 8 is a view similar to that of FIG. 7, with the CPA member moved back to its inoperative position, and with the latch on the wire shroud being depressed to unlatch the mating assist lever;

DETAILED DESCRIPTION OF THE PREFERRED EMBODIMENT

Figure 1:
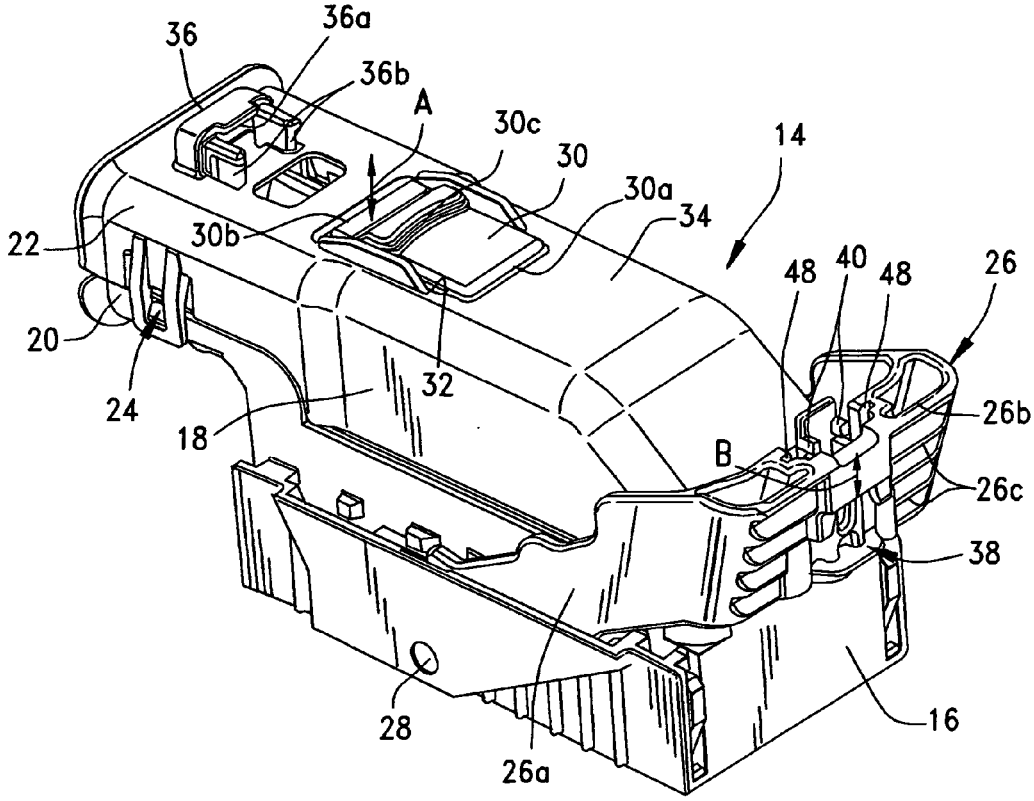
FIG. 1 is a perspective view of a lever-type electrical connector embodying the concepts of the invention, with the mating assist lever in its inoperative position.
Figure 2:
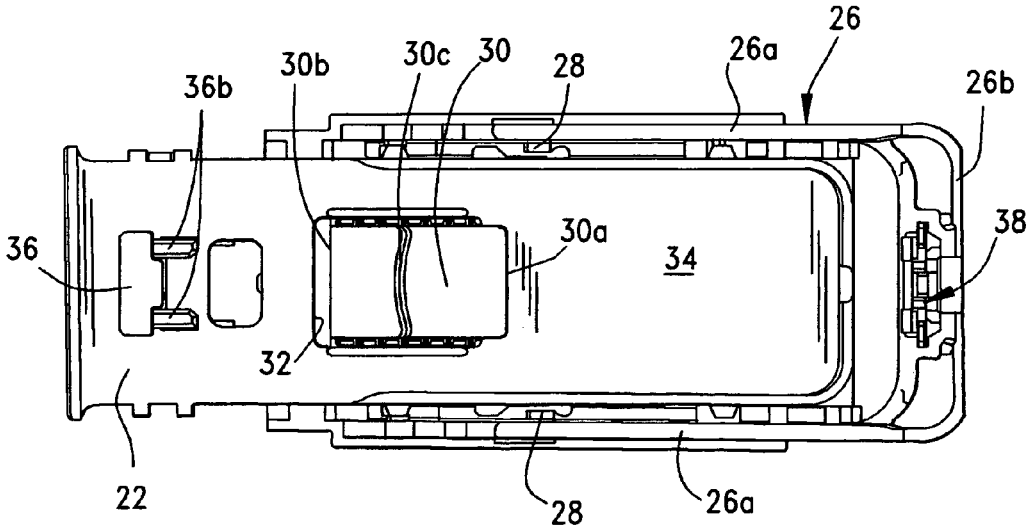
FIG. 2 is a top plan view of the connector in the condition of FIG. 1.

Referring to the drawings in greater detail, and first to FIGS. 1 and 2, the invention is embodied in a lever-type electrical connector, generally designated 14, which includes a connector body 16 and a wire shroud 18 secured to the top of the connector body. As is known in the art, connector body 16 mounts a plurality of conductive terminals (not visible in the drawings). The connector body is mateable with a second or complementary mating connector whereby the terminals of the mating connector interengage with the terminals of connector 14. The connector body has a bracket portion 20 and the wire shroud has a bracket portion 22 which combine to define a mouth through which a plurality of electrical wires (not shown) extend for electrical connection to the terminals within connector body 16, as is known in the art. The bracket portions are latched together by an interengaging latching structure, generally designated 24.

Connector 14 is a lever-type connector which includes a mating assist lever, generally designated 26. The lever is pivotally mounted to connector body 16, as at 28. The lever is generally U-shaped and includes a pair of lever arms 26*a* joined by a cross portion 26*b* which has a plurality of ridges 26 on the outer surface thereof to facilitate manually moving the lever. Lever arms 26*a* are pivotally mounted to the connector body, as at 28, at opposite sides of the body, whereby U-shaped lever 26 straddles wire shroud 18.

Still referring to FIGS. 1 and 2, wire shroud 18 may be molded of plastic material, and a flexible latch tab 30 is molded integrally with the wire shroud at a base end 30*a* of the latch tab so that a free latching edge 30*b* is flexible in the direction of double-headed arrow "A". The latch tab is formed out of an opening 32 in a top wall 34 of wire shroud 18, and the latch tab flexes within that opening. A raised serrated rib 30*c* projects upwardly from latch tab 30 for engagement by an operator, such as an operator's thumb.

FIG. 1 also shows best that a bridge 36 projects upwardly from top wall 34 of wire shroud 18 and defines a locking ledge 36*a* for a CPA member as will be described hereinafter. A pair of laterally spaced release members or walls 36*b* project inwardly from bridge 36, for purposes described hereinafter.

Finally as referring to FIG. 1, a connector position assurance (CPA) member, generally designated 38, is slidably mounted on cross portion 26*b* of U-shaped lever 26 for sliding movement relative thereto in the direction of double-headed arrow "B". FIG. 1 clearly shows that the cross portion of the lever has a pair of blocking shoulders 40 which are shown in FIG. 1 blocking any movement of CPA member 38. The relationship of blocking shoulders 40 and the movement of the CPA member will be made more clear hereinafter, but FIG. 1 clearly shows where the blocking shoulders are located in relation to lever 26 and CPA member 38.

Before going into the details of the CPA system of the invention, a general description is in order with reference to FIGS. 1–4. In particular, mating assist lever 26 is pivotally movable between an inoperative position shown in FIGS. 1 and 2 to a latched position shown in FIGS. 3 and 4. In the latched position, latching edge 30*b* of flexible latch tab 30 snaps into latching engagement behind a trailing edge 42 of cross portion 26*b* of lever 26. This prevents the lever from moving out of its latched position unless flexible latch tab 30 is depressed inwardly to disengage latching edge 30*b* of the latch tab with trailing edge 42 of the lever. Once the lever is in its latched position of FIGS. 3 and 4, CPA member 38 is released and is movable from an inoperative position shown in FIG. 1 to a locked position shown in FIGS. 3 and 4 and described in greater detail hereinafter. Suffice it to say, portions of the CPA member move under locking ledge 36*a* (FIG. 1) of bridge 36 to positively lock the lever in its latched position.

Figure 5:
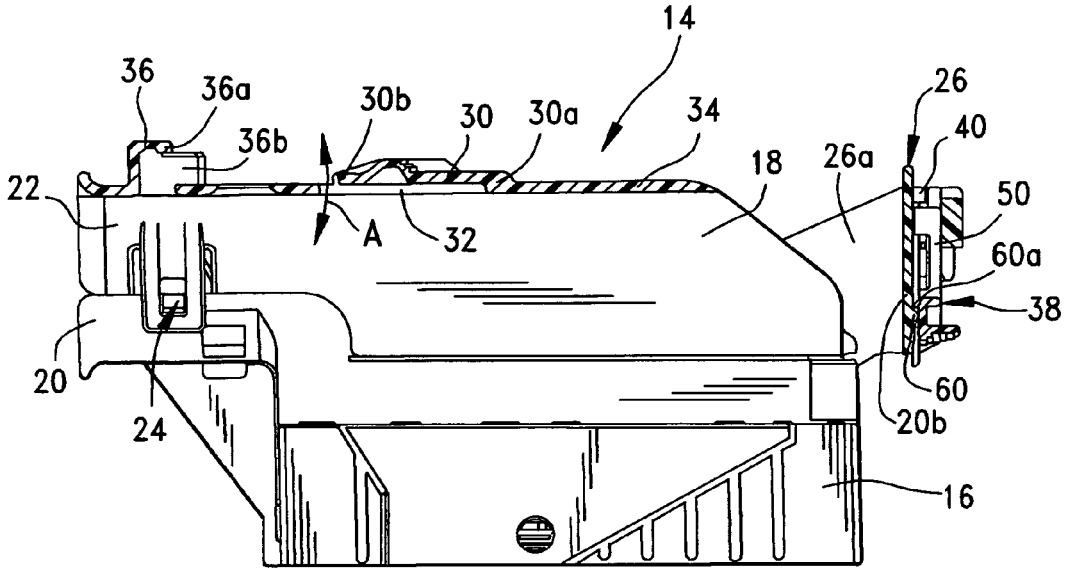
FIG. 5 is a side elevational view of the connector in the condition of FIGS. 1 and 2, but showing a section through the wire shroud, mating assist lever and CPA member.

The sectional views of FIGS. 5–8 show further details of the operation described above. Specifically, FIG. 5 shows mating assist lever 5 in its inoperative position of FIGS. 1 and 2, along with CPA member 38 also in its inoperative position. FIG. 5 clearly shows that flexible latch tab 30 has free latching edge 30*b* movable in the direction of double-headed arrow "A" within opening 32 in top wall 34 of wire shroud 18. FIG. 5 also shows how locking ledge 36*a* of bridge 36 has an open area therebeneath.

Figure 6:
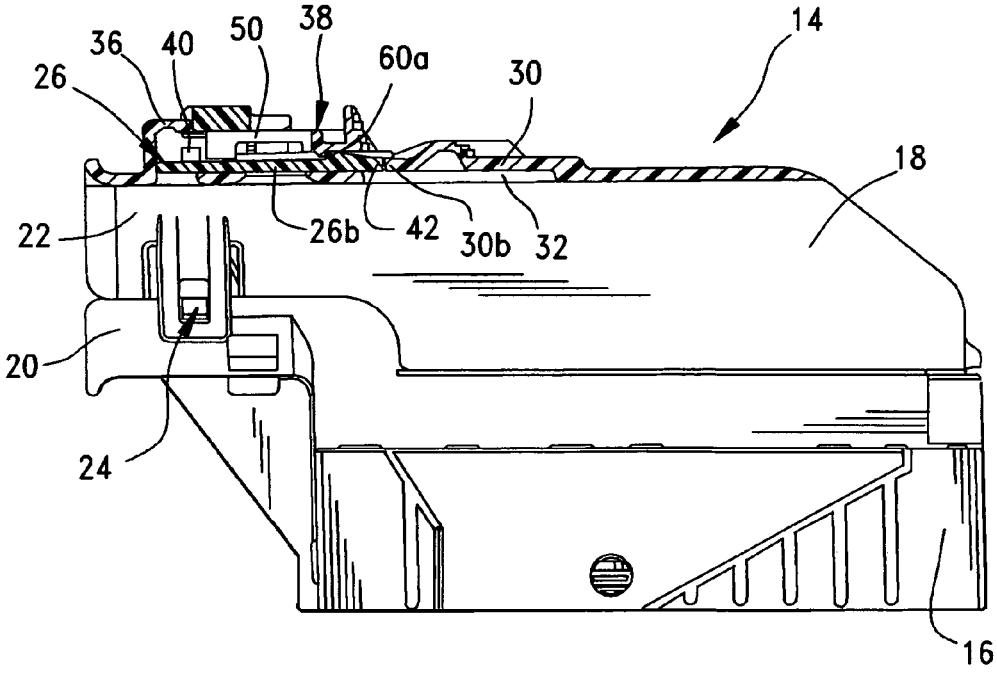
FIG. 6 is a view similar to that of FIG. 5, but with the mating assist lever moved to its latched position of FIGS. 3 and 4.

FIG. 6 shows lever 26 moved to its latched position with trailing edge 42 of cross portion 26*b* of the lever latched behind latching edge 30*b* of flexible latch tab 30. CPA member 38 is still in its inoperative position.

FIG. 7 shows lever 26 still in its latched position, but CPA member 38 has been moved slidably in the direction of arrow "B" until portions of the CPA member move into locked position beneath locking ledge 36*a* of bridge 36 on the top of wire shroud 18. This movement of the CPA member to its locked position not only visually indicates to an operator that the lever is fully latched and the connectors are fully mated, but the CPA member provides a positive lock for the lever regardless of whether or not flexible latch tab 30 is inadvertently depressed.

FIG. 8 shows how lever 26 is released in order to move the lever back from its latched and locked position to its inoperative position to unmate the connectors. First, CPA member 38 is move back from its locked position to its inoperative position in the direction of arrow "B", as shown. Flexible latch tab 30 is depressed in the direction of arrow "E" to move free latching edge 30*b* thereof out of latching engagement with trailing edge 42 on cross portion 20*b* of lever 26. The lever now is free to be pivoted in the direction of arrow "F" for pivoting movement back to its inoperative position and allow unmating of the connectors.

Figure 9:
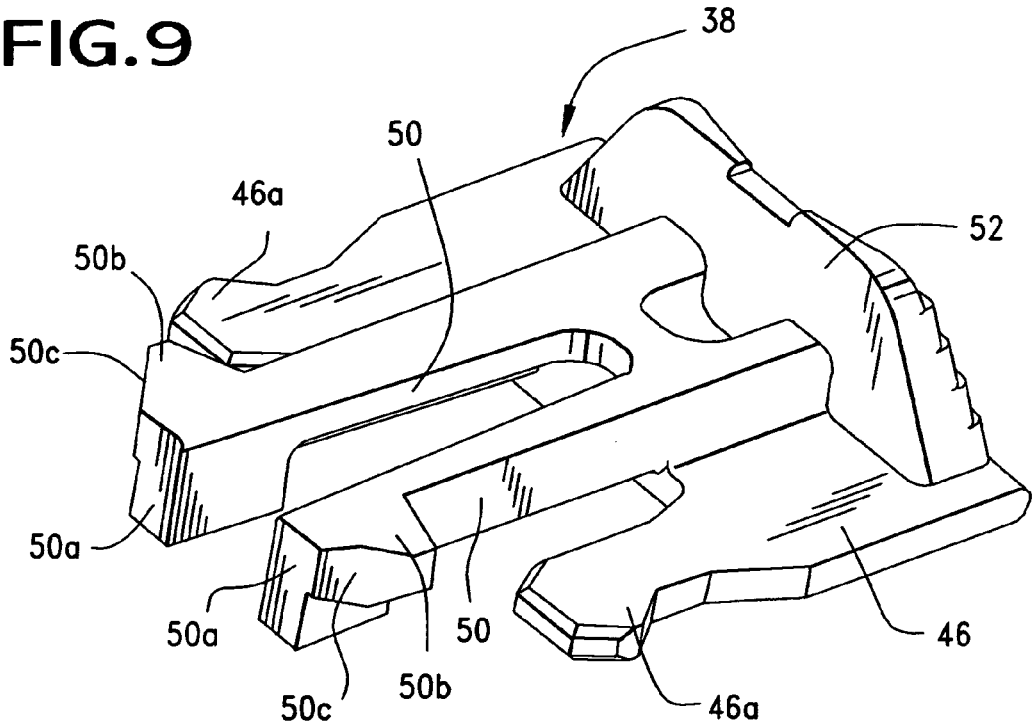
FIG. 9 is an enlarged perspective view of the CPA member removed from the connector.

FIG. 9 shows the details of CPA member 38. The CPA member may be molded of plastic material and includes a generally planar base 46 which includes a pair of side wings 46*a* which ride in a pair of guide slots 48 (FIG. 1) in cross portion 26*b* of lever 26. The wings and guide slots guide the CPA member in its movement between its inoperative position (FIG. 6) to its locked position (FIG. 7). The CPA member includes a pair of flexible retaining arms 50 which include front stop shoulders 50*a*. A release tab 50*b* projects laterally outwardly from the distal end of each retaining arm 50. The front edge of each release tab 50*b* has a chamfered or angled surface 50*c*. Finally, an upstanding serrated flange 52 extends across the rear of CPA member 38 for engagement by an operator's fingers and/or thumb.

Figure 10:
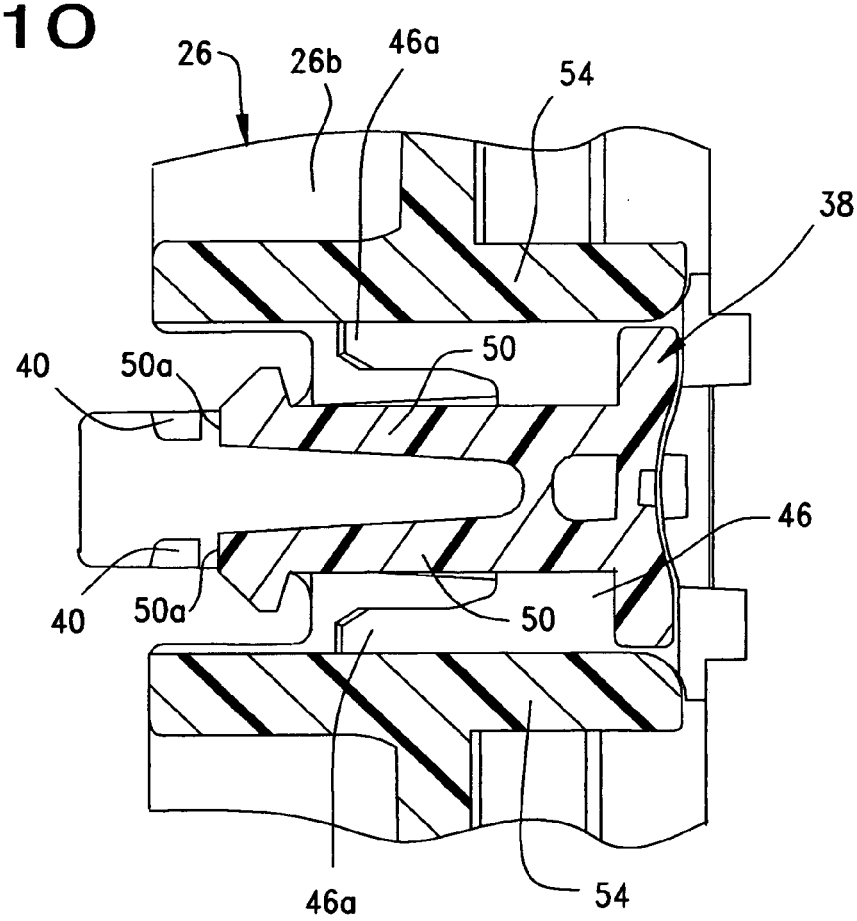
FIG. 10 is a horizontal section through the CPA member and portions of the mating assist lever, showing the CPA member in its inoperative position.

FIG. 10 shows CPA member 38 in its inoperative position between a pair of walls 54 on cross portion 56*b* of lever 26. Wings 46*a* are disposed in guide slots 48 (FIG. 1). Stop shoulders 50*a* are aligned with blocking shoulders 40 on the lever so that the CPA member cannot move from its inoperative position as shown, to its locked position. As will be seen in greater detail hereinafter, a latch means on the underside of the CPA member prevents the CPA member from moving out of its inoperative position (to the right as viewed in the drawing) from within walls 54. It should be understood that this condition of the CPA member in its inoperative position is before lever 26 is pivoted to its latched position.

Figure 3:
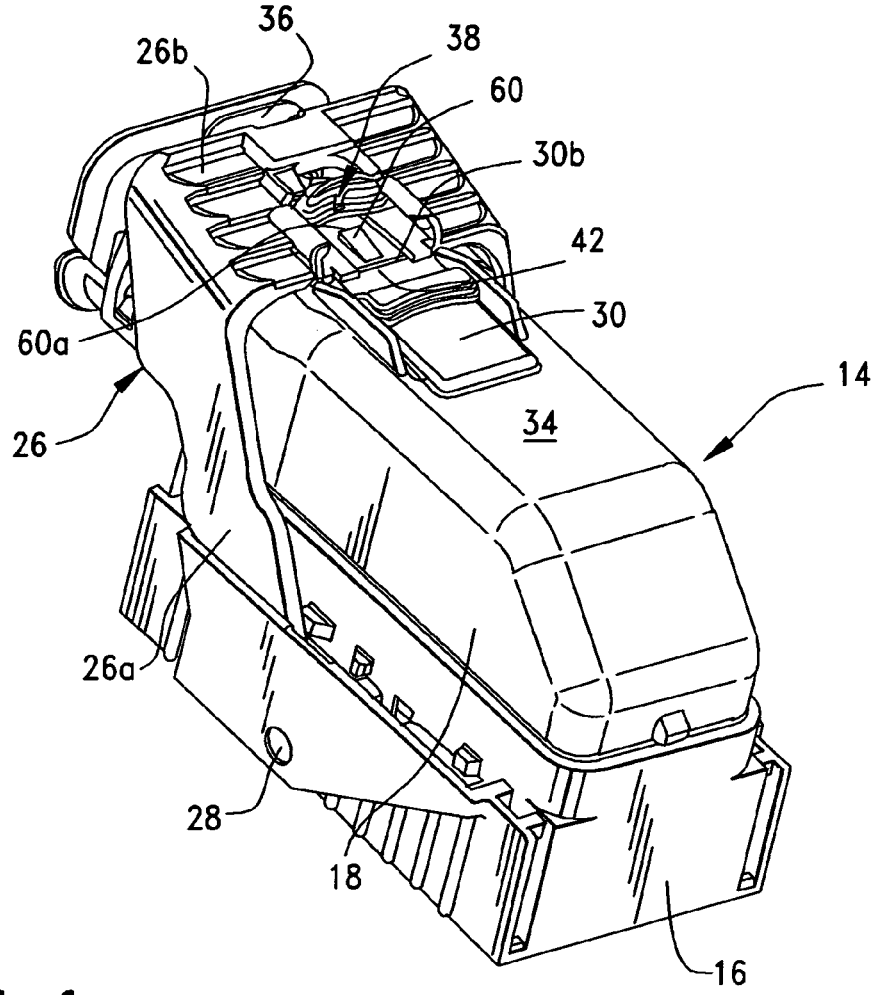
FIG. 3 is a perspective view of the connector, with the mating assist lever in its latched position.
Figure 4:
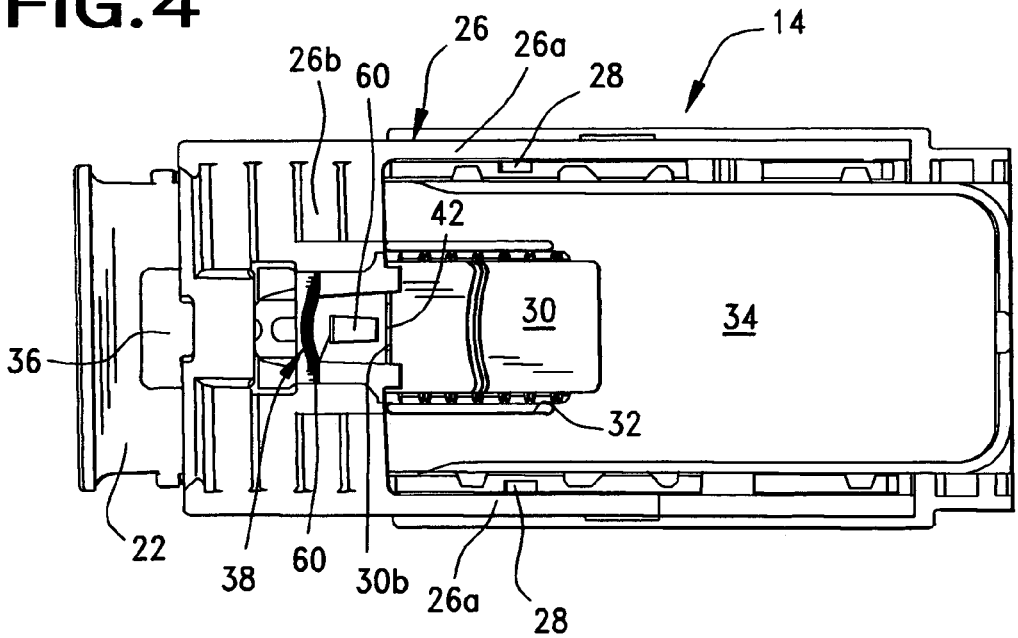
FIG. 4 is a top plan view of the connector in the condition of FIG. 3.
Figure 11:
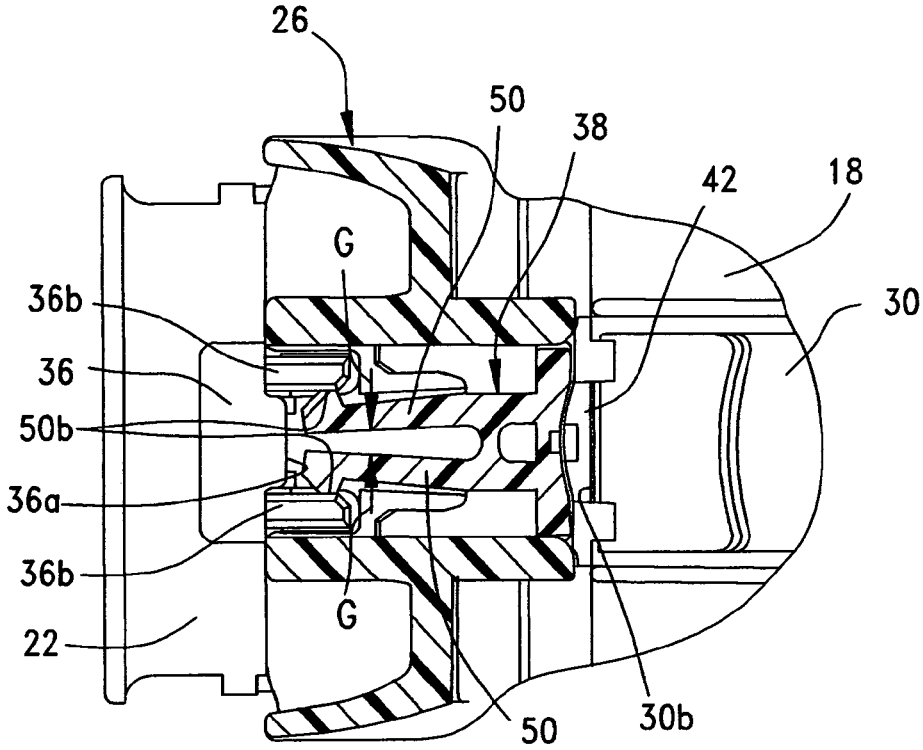
FIG. 11 is a view similar to that of FIG. 10, but with the CPA member shown in conjunction with the release means on the wire shroud which is moving the flexible release arms on the CPA member toward each other.

FIG. 11 shows the condition of the CPA member when lever 26 has been moved to its latched position of FIGS. 3, 4 and 6. When the lever is pivoted downwardly to its latched position, release members or walls 36*b* on the top of wire shroud 18 engage angled surfaces 56*c* (FIG. 9) on release tabs 50*b* of flexible retaining arms 50. The release walls are effective to bias retaining arms 50 toward each other in the direction of arrows "G". The result is that stop shoulders 50*a* on the retaining arms are moved out of alignment with stop shoulders 40 on lever 26 as described above in relation to FIG. 10. It can be seen in both FIGS. 1 and 11 that the top peripheral edges of release walls 36*b* are chamfered to facilitate engaging angled surfaces 50*c* to move retaining arms 50 inwardly toward each other. In essence, release walls 36*b* provide a release means for the CPA member to enable the CPA member to move to its fully locked position.

Figure 12:
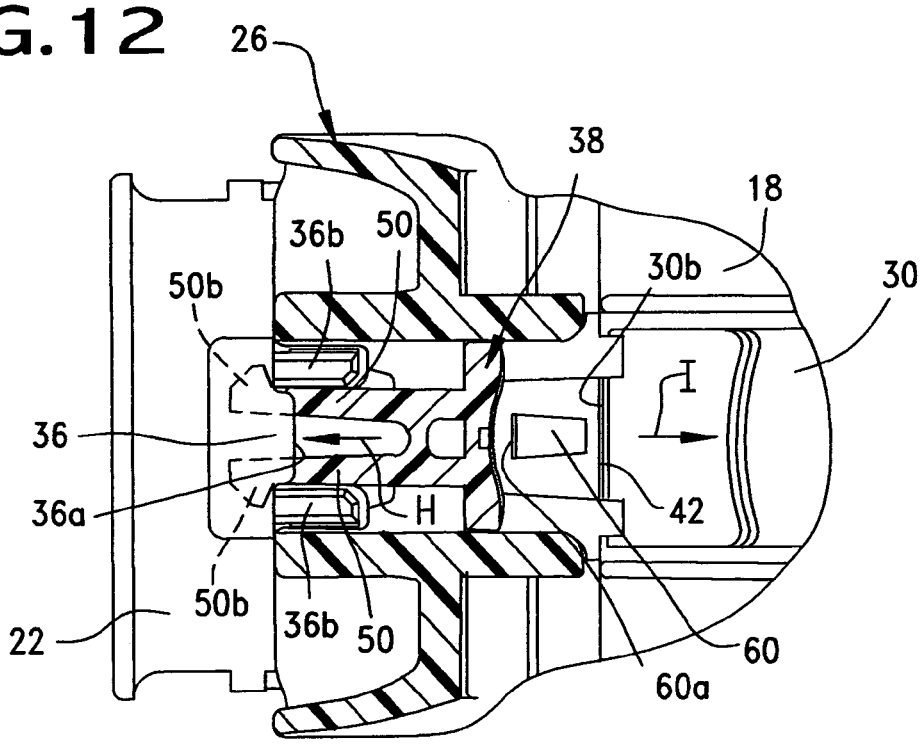
FIG. 12 is a view similar to that of FIG. 11, with the CPA member moved to its fully locked position.

FIG. 12 shows CPA member 38 moved in the direction of arrow "H" to its fully locked position which positively locks lever 26 in its latched position. It can be seen in FIG. 12 that the distal ends of retaining arms 50 have moved under locking ledge 36*a* of bridge 36 to prevent the lever from pivoting upwardly away from its latched position regardless of whether flexible latch tab 30 is depressed or not. In addition, FIG. 12 shows that release tabs 50*b* on the ends of release arms 50 have snapped back outwardly behind release walls 36*b* to hold the CPA member in its locked position. When it is desired to move the CPA member back to its inoperative position, an operator grasps flange 52 (FIG. 9) and simply pulls the CPA member back, whereas release tabs 50*b* engage the inner ends of release walls 36*b* and bias release arms 50 inwardly so that the CPA member can be moved back to its inoperative position. Flexible latch tab 30 then can be depressed to allow lever 26 to be pivoted back to its inoperative position to unmate the connectors, as described above.

Finally, FIG. 12 shows a latch ramp 60 having a front latching shoulder 60*a*. This latching shoulder engages a complementary shoulder (not visible in the drawing) on the underside of CPA member and forms the latch means described above to prevent the release member from being pulled out of its inoperative position in the direction of arrow "I" (FIG. 12).

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. An electrical connector, comprising:

a connector body;

a wire shroud secured to the connector body;

a mating assist lever pivotally mounted on the connector body so as to be pivotable between an inoperative position and a latched position;

a connector position assurance (CPA) member slidably mounted on the mating assist lever so as to be slidable between an inoperative position and a locked position;

at least one retaining arm and a locking ledge positioned between the CPA member and the wire shroud to horizontally lock the mating assist lever in its latched position when the CPA member is moved to its locked position; and a latching edge and trailing edge located between the mating assist lever and the wire shroud to hold the mating assist lever in its latched position.

2. The electrical connector of claim 1 wherein said mating assist lever is generally U-shaped and has a pair of lever arms joined by a cross portion, the lever arms being pivotally mounted to the connector body, and said CPA member is slidably mounted on said cross portion.

3. The electrical connector of claim 1 wherein said said locking ledge includes a ledge on the wire shroud beneath which a portion of the CPA member moves to its locked position when the mating assist lever is in its latched position.

4. An electrical connector, comprising:

a connector body;

a wire shroud secured to the connector body;

a mating assist lever pivotally mounted on the connector body so as to be pivotable between an inoperative position and a latched position;

a connector position assurance (CPA) member slidably mounted on the mating assist lever so as to be slidable between an inoperative position and a locked position;

at least one retaining arm and a locking ledge positioned between the CPA member and the wire shroud to horizontally lock the mating assist lever in its latched position when the CPA member is moved to its locked position; and a front stop shoulder and a blocking shoulder positioned between the CPA member and the mating assist lever to prevent the CPA member from slidably moving from its inoperative position until the lever is in its latched position.

5. The electrical connector of claim 4, including release walls on the wire shroud for releasing said front stop shoulder and said blocking shoulder when the mating assist lever is in its latched position and, thereby, allow the CPA member to move from its inoperative position to its locked position.

6. The electrical connector of claim 4 wherein said wire shroud includes a release member engageable with said flexible retaining arm when the mating assist lever is in its latched position to move the arm out of engagement with said blocking shoulder so that the CPA member can move from its inoperative position to its locked position.

* * * * *